US007451625B2

(12) United States Patent
Park

(10) Patent No.: US 7,451,625 B2
(45) Date of Patent: Nov. 18, 2008

(54) STRUCTURE FOR COOLING MOTOR OF WASHING MACHINE

(75) Inventor: Yong Suck Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 577 days.

(21) Appl. No.: 10/720,345

(22) Filed: Nov. 25, 2003

(65) Prior Publication Data

US 2004/0154345 A1 Aug. 12, 2004

(30) Foreign Application Priority Data

Nov. 25, 2002 (KR) ..... 10-2002-0073583
Nov. 25, 2002 (KR) ..... 10-2002-0073584

(51) Int. Cl.
*D06F 23/04* (2006.01)

(52) U.S. Cl. ..... 68/3 R; 68/133

(58) Field of Classification Search ..... 68/3 R, 68/13 R, 235 R, 133
See application file for complete search history.

(56) References Cited

U.S. PATENT DOCUMENTS 2,313,896 A * 3/1943 Scheble ..... 210/168
3,217,193 A * 11/1965 Rayner ..... 310/54
3,274,410 A * 9/1966 Boivie ..... 310/62

FOREIGN PATENT DOCUMENTS

| | | | |
|---|---|---|---|
| FR | 2797170 | * | 2/2001 |
| JP | 04-033536 | A | 2/1992 |
| JP | 5-231387 | * | 9/1993 |
| JP | 10-210727 | * | 8/1998 |
| JP | 11-99072 | * | 4/1999 |
| JP | 11-347288 | * | 12/1999 |
| JP | 2000-270517 | A | 9/2000 |
| KR | 2000-52275 | A | 8/2000 |

OTHER PUBLICATIONS

European Patent Office 0 445 100 Sep. 1991.*

* cited by examiner

*Primary Examiner*—Frankie L. Stinson
(74) *Attorney, Agent, or Firm*—Birch, Stewart, Kolasch & Birch, LLP

(57) ABSTRACT

A structure for cooling a motor of a washing machine is disclosed, which is suitable for improving cooling efficiency of the motor. A structure for cooling a motor of a washing machine, the washing machine provided with a motor assembly including a cylindrical rotor in an inner circumferential surface of a rotor housing, and a cylindrical rotor in an inner circumferential surface of the rotor, is provided with a plurality of holes on a lower surface of the rotor housing forming the stator; and a plurality of blades, each provided in one side of the hole.

10 Claims, 4 Drawing Sheets

STRUCTURE FOR COOLING MOTOR OF WASHING MACHINE

This application claims the benefit of the Korean Application Nos. P2002-73583, P2002-73584 and P2002-74608 filed on Nov. 25, 2002, which is hereby incorporated by reference.

BACKGROUND OF THE INVENTION

1. Field of the Invention

The present invention relates to a motor of a washing machine, and more particularly, to a structure for cooling a motor of a washing machine.

2. Discussion of the Related Art

FIG. 1 is a cross-sectional view illustrating a related art washing machine.

As shown in FIG. 1, the related art washing machine is provided with a cabinet 100, an outer tub 110 and an inner tub 120. At this time, the outer tub 110 is supported with a damper, and the cylindrical inner tub 120 is rotatably provided inside the outer tub 110 to receive laundry therein. In the related art washing machine, a rotation power is generated by a motor, and then transmitted to the inner tub 120, whereby the inner tub 120 is rotated, thereby washing the laundry inside the inner tub 120.

The motor is provided so as to directly transmit the power generated by a rotor 130*a* and a stator 130*b* to a shaft 140 of the inner tub 120. That is, the motor is provided with the stator 130*b* receiving an electric current and generating a rotary magnetic field, and the rotor 130*a* generating the rotation power with the rotary magnetic field. According as the rotor 130*a* and a spin shaft press-fitted to the rotor 130*a* are rotated, the rotation power is directly transmitted to the shaft of the inner tub 120.

An operation of the related art washing machine will be described as follows.

When the motor is driven in regular/reverse directions, the rotation power of the motor is applied to the inner tub 120. As the inner tub 120 receiving the rotation power is rotated in regular/reverse directions, the laundry is washed according to impact action of washing water circulation and resolution action of detergent.

On driving the motor in regular/reverse directions, the heat is generated as the current is applied to a wire of the stator 130*b*. Then, the heat is transmitted to the stator 130*b*, so that the heat is dispersed in the circumference of the stator 130*b*. That is, the stator 130*b* serves as a guide of the wire. Simultaneously, the stator 130*b* disperses the heat generated in the wire so as to cool the motor. However, as mentioned above, in case of that the heat generated in the wire is dispersed spontaneously, cooling efficiency is lowered.

Meanwhile, a structure for cooling the motor of the washing machine according to the related art is provided with a rotor housing. Hereinafter, the structure for cooling the motor of the washing machine according to the related art will be described in detail.

FIG. 2 is a plan view illustrating a rotor housing 150 according to the related art, and FIG. 3 is a cross-sectional view taken along line B-B' of FIG. 2.

The rotor housing 150 is provided in the circumference of the stator 130*b*. Also, as shown in FIG. 2, the rotor housing 150 is provided with a plurality of holes 210 and blades 220 at fixed intervals on a lower inner surface thereof. That is, referring to FIG. 3, the blade 220 is provided in the right side of the hole 210 to a central point of the rotor housing 150, whereby the blade 220 is provided at the same direction as a rotation of a dehydration process.

Thus, if the motor is rotated, the outside cold air flows into the inside of the rotor housing 150 by the blades 220, thereby cooling the inside of the motor assembly, the rotor 130*a* and the stator 130*b*. That is, the hot air inside the rotor housing 150 is moved upwardly, and then exhausted through a space between the rotor housing 150 and the outer tub.

However, the structure for cooling the motor of the washing machine according to the related art has the following disadvantages.

First, the blade 220 is provided in the side of the hole 210 to the central point of the rotor housing 150 at the same direction as the rotation of the dehydration process. When the motor is continuously rotated in the regular direction on the dehydration process, the outside air flows into the inside of the rotor housing 150 through the hole 210 in a small amount, thereby lowering the cooling efficiency.

Also, the blade 220 is provided in the side of the hole 210 for being upward to the lower surface of the rotor housing 150, whereby the outside cold air flows into the inside of the rotor housing 150 so as to cool the inside of the motor. At this time, the hot air inside the motor has bad effects on components adjoining to the upper part of the rotor 130*a* until the hot air is exhausted through the space between the outer tub and the rotor housing 150.

SUMMARY OF THE INVENTION

Accordingly, the present invention is directed to a structure for cooling a motor of a washing machine using the same that substantially obviates one or more problems due to limitations and disadvantages of the related art.

An object of the present invention is to provide a structure for cooling a motor of a washing machine, for improving cooling efficiency of motor.

Another object of the present invention is to provide a structure for cooling a motor of a washing machine, for preventing the temperature in components adjoining to the motor from rising.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a structure for cooling a motor of a washing machine, the washing machine provided with a motor assembly including a cylindrical rotor in an inner circumferential surface of a rotor housing, and a cylindrical rotor in an inner circumferential surface of the rotor, is provided with a plurality of holes on a lower surface of the rotor housing forming the stator; and a plurality of blades, each provided in one side of the hole.

At this time, the blade is provided downward to the lower surface of the rotor housing.

Also, the blade is provided by downwardly bending the lower surface of the rotor housing.

Also, the blade is provided downward to the lower surface of the rotor housing in perpendicular.

Also, a plurality of grooves are provided in the surface of the blade.

Also, the blade is provided in one side of the hole for being opposite to a dehydration direction to a central point of the rotor housing.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a motor assembly of a washing machine according to the present invention will be described with reference to the accompanying drawings.

Figure 1:
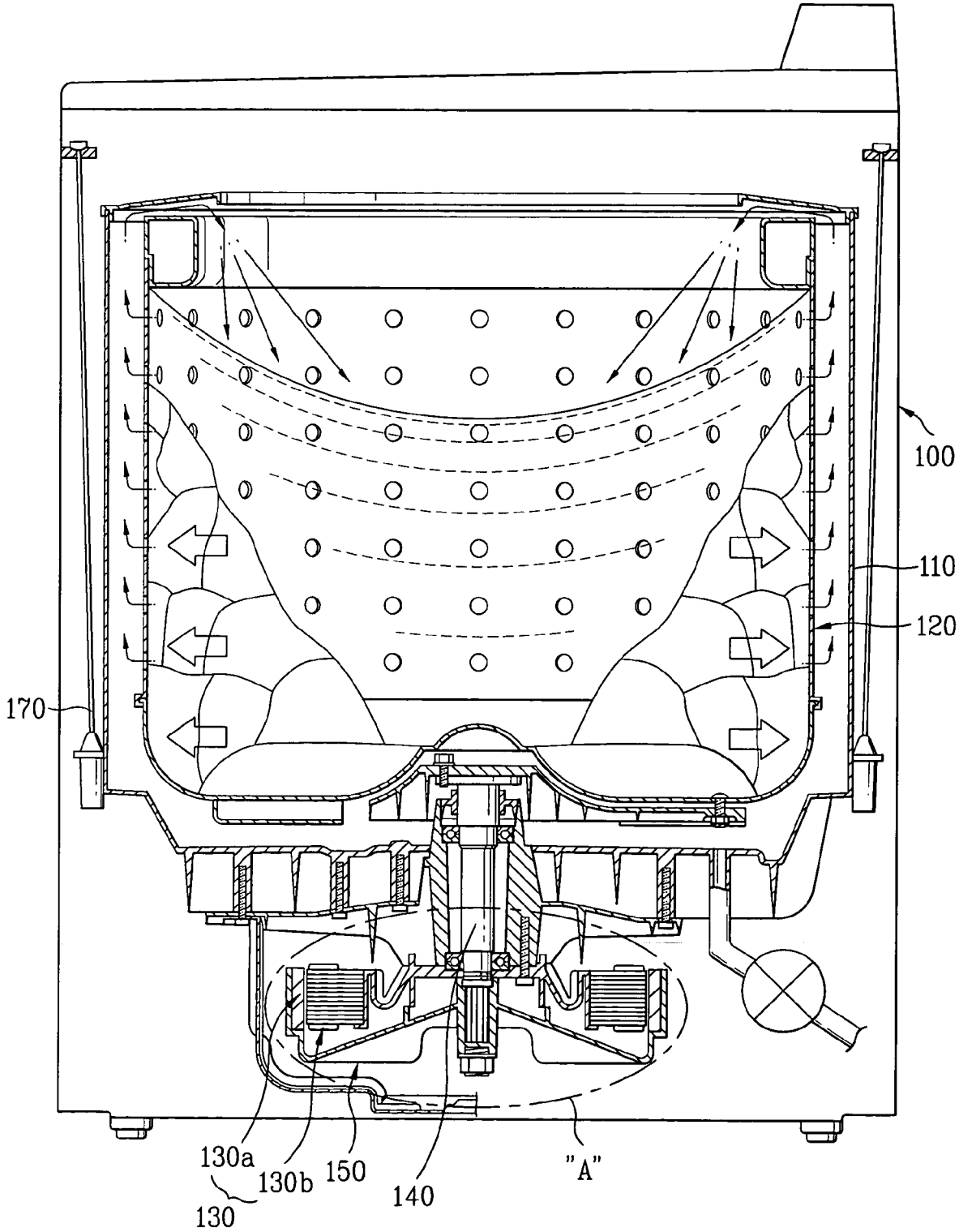
FIG. 1 Prior Art
FIG. 1 is a cross-sectional view illustrating a related art washing machine.
Figure 2:
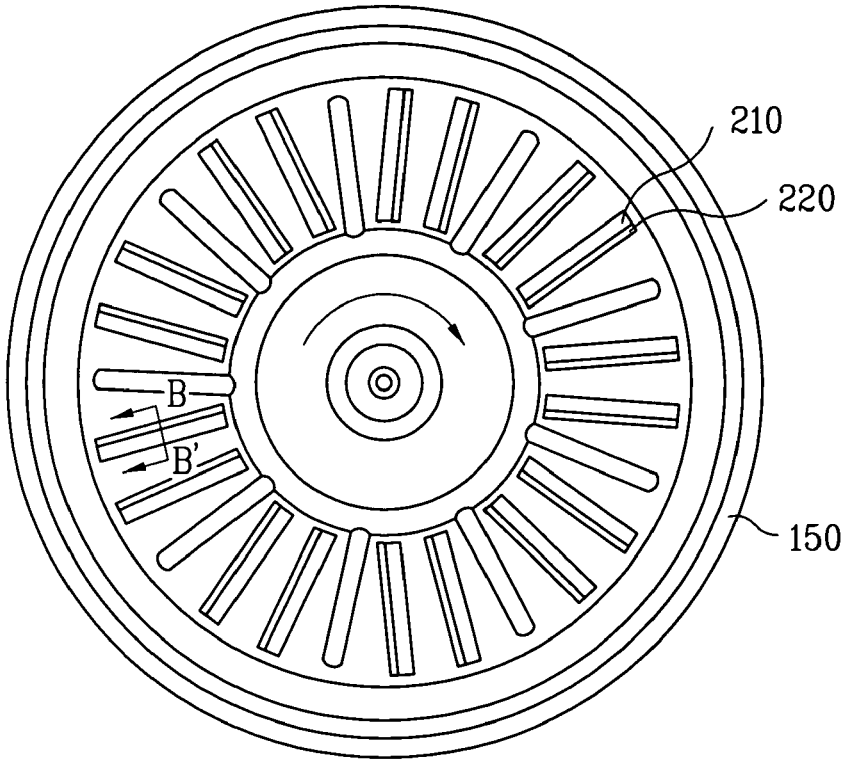
FIG. 2 Prior Art
FIG. 2 is a plan view illustrating a rotor housing according to the related art.
Figure 3:
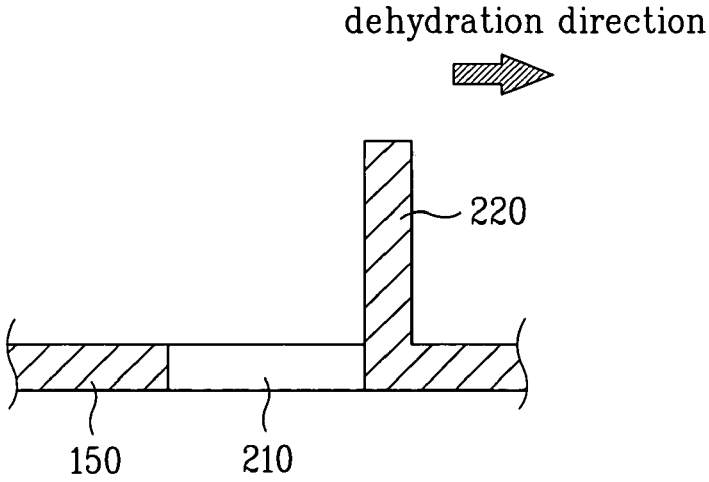
FIG. 3 Prior Art
FIG. 3 is a cross-sectional view taken along line B-B' of FIG. 2.
Figure 4:
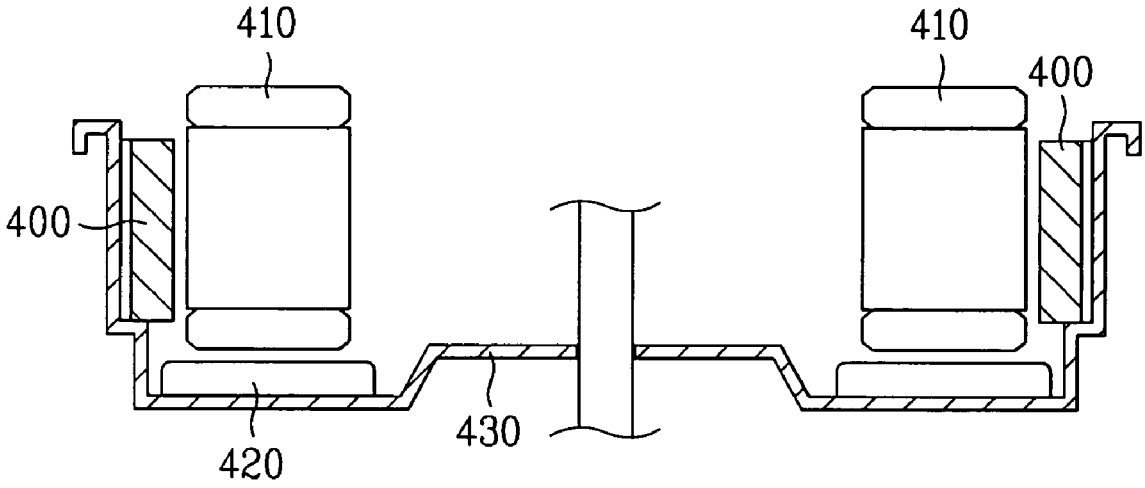
FIG. 4 is a cross-sectional view illustrating a motor assembly according to the present invention.

FIG. 4 is a cross-sectional view illustrating a motor assembly according to the present invention. As shown in FIG. 4, the motor assembly is provided with a stator 410, a rotor 400, and a rotor housing 430. At this time, a plurality of coils are wired so as to form the cylindrical stator 410, and the rotor 400 is a cylindrical core provided in a circumferential surface of the stator 410. Also, a spin shaft (not shown) is provided to transmit a rotation power of the rotor 400 in a perpendicular direction, and a coupling is provided to connect the spin shaft with the rotor 400, whereby the rotation power of the rotor 400 is directly transmitted to an inner tub 120.

An operation of the washing machine having the motor assembly therein will be described as follows.

When an electric current is applied to the stator 410, a magnetic field is formed between the stator 410 and the rotor 400, and the rotor 400 is rotated in the circumferential surface of the stator 410 at a high speed. Thus, the rotation power of the rotor 400 is transmitted to the spin shaft (not shown) press-fitted to the rotor 400. Then, the inner tub 120 connected to an upper part of the spin shaft is rotated, whereby the laundry and washing water received in the inner tub 120 are bumped into a side wall of the outer tub 110 by a centrifugal force, thereby washing the laundry.

In this state, a plurality of holes 440 are provided on a lower inner surface of the rotor housing 430 forming the stator 410, and a blade 420 is provided in one side of the hole 440 to a central point of the rotor housing 430, for being opposite to a rotation direction of a dehydration process (first embodiment of the present invention), or a blade 420 is provided in one side of the hole 440 by bending the lower surface of the rotor housing 430 downwardly (second embodiment of the present invention).

Hereinafter, the motor assembly of the washing machine according to the present invention will be described in more detail.

FIRST EMBODIMENT

Figure 5:
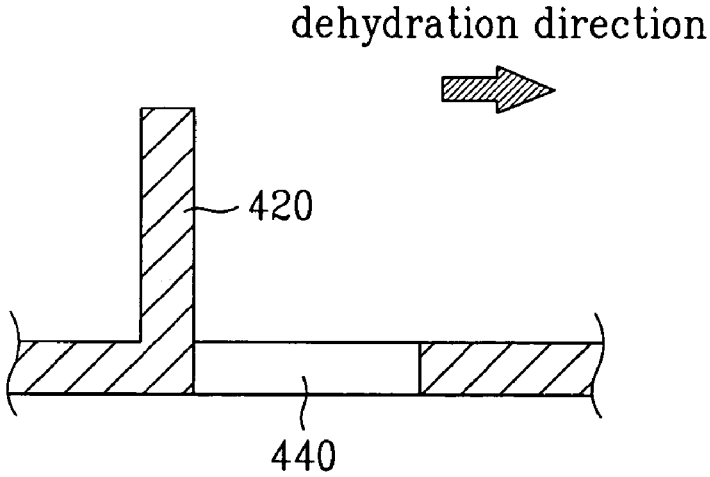
FIG. 5 is a cross-sectional view illustrating a plurality of holes and blades on a lower surface of a rotor housing according to the first embodiment of the present invention.

FIG. 5 is a cross-sectional view illustrating a plurality of holes and blades on a lower surface of a rotor housing according to the first embodiment of the present invention.

As shown in FIG. 5, a hole 440 and a blade 420 are simultaneously provided by partially bending a lower surface of a rotor housing 430 at fixed intervals. That is, the lower surface of the rotor housing 430 is upwardly bent at a predetermined angle or inclination, or at an angle of 90° in perpendicular. Preferably, the blade 420 is provided in one side of the hole 440 for being opposite to a dehydration direction. For example, if the dehydration direction is counter clockwise to a central point of the rotor housing 430, the blade 420 is provided in the right side of the hole 440.

Meanwhile, the hole 440 and the blade 420 are provided in a lancing processing method, which is a metal plate processing method used for fabricating a heat radiation window of illuminating and cooling devices. This method is performed with bending and cutting process by a press mold.

Accordingly, when the motor assembly is rotated, the outside cold air flows into the inside of the rotor housing 430 through the hole 440, thereby cooling the inside of the motor including the rotor 400 and the stator 410. Simultaneously, the hot air inside the motor assembly is moved upwardly, and exhausted to the outside through a space between an outer tub and the rotor housing 430.

At this time, the blade 420 is provided in the side of the hole 440 for being opposite to the dehydration direction, whereby it is possible to maximize the amount of the cold air flowing into the inside of the rotor housing 430 through the hole 440 on an operation mode of the motor. As a result, the inflow amount of the cold air increases during all cycles such as washing, rinsing and dehydrating processes, thereby improving cooling efficiency of the motor.

SECOND EMBODIMENT

Figure 6:
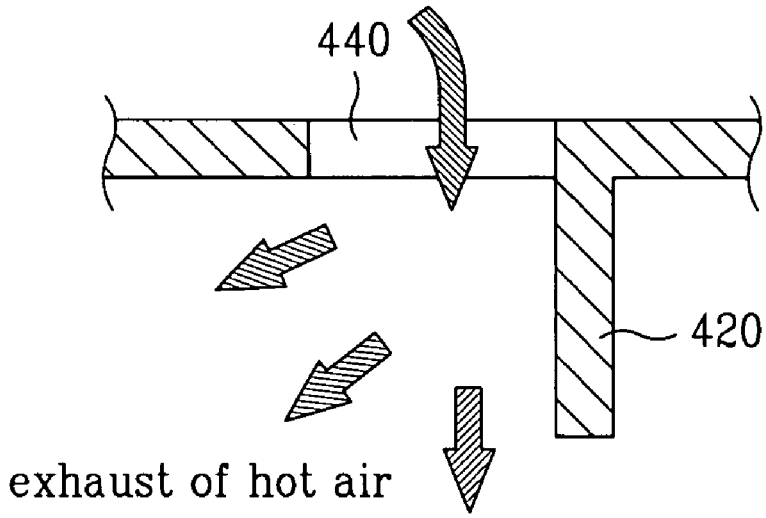
FIG. 6 is a cross-sectional view illustrating a plurality of holes and blades on a lower surface of a rotor housing according to the second embodiment of the present invention.

FIG. 6 is a cross-sectional view illustrating a plurality of holes and blades on a lower surface of a rotor housing according to the second embodiment of the present invention. As shown in FIG. 6, a hole 440 and a blade 420 are simultaneously provided by partially bending a lower surface of the rotor housing 430 at fixed intervals.

Figure 7:
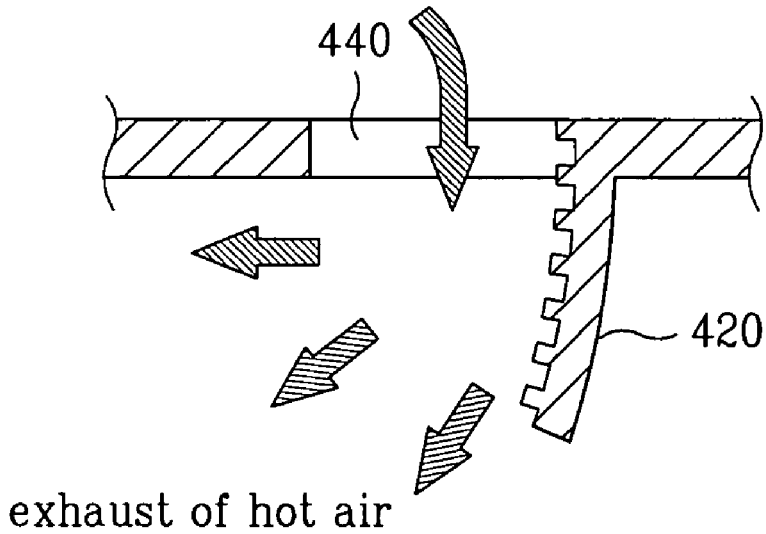
FIG. 7 is a cross-sectional view illustrating a plurality of holes and blades on a lower surface of a rotor housing in another method according to the second embodiment of the present invention.

Also, as shown in FIG. 7, the blade 420 is provided in one side of the hole 440 for being downward to the lower surface of the rotor housing 430. In addition, the blade 420 has a curved guide surface, and a plurality of grooves are provided in the surface of the blade 420.

Accordingly, the lower surface of the rotor housing 430 is downwardly bent at a predetermined angle or inclination, or at an angle of 90° in perpendicular.

Meanwhile, the hole 440 and the blade 420 are provided in a lancing processing method, which is a metal plate processing method used for fabricating a heat radiation window of illuminating and cooling devices. This method is performed with bending and cutting process by a press mold.

As mentioned above, when the motor assembly is rotated, the hot air inside the rotor housing 430 is exhausted through the hole 440 by the blade 420. As the hot air inside the motor assembly is exhausted through the hole 440 in the lower side of the rotor housing 430, the outside cold air flows into the inside of the rotor housing 430 through a space between an outer tub and the rotor housing 430 by convection. As a result, it is possible to cool the inside of the motor including a rotor 400 and a stator 410, and to prevent the temperature in adjoining components such as a bearing housing fixed to an upper part of the rotor 400 from rising, simultaneously.

As mentioned above, the structure for cooling the motor of the washing machine according to the present invention has the following advantages.

In the structure for cooling the motor of the washing machine according to the present invention, the blade is provided in one side of the hole for being opposite to the dehydration direction, whereby the outside cold air inflows into the inside of the rotor housing through the hole when operating the motor. Thus, it is possible to maximize the inflow amount of the air, thereby cooling the motor effectively. That is, it is possible to prevent the temperature of the stator from rising.

In the structure for cooling the motor of the washing machine according to the present invention, the blade is provided by bending the lower surface of the rotor housing downwardly, so as to cool the inside of the rotor housing when driving the motor. Thus, it is possible to cool the motor effectively, and to prevent the adjoining components from being heated, thereby improving production reliability.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A structure for cooling a motor of a washing machine, the washing machine provided with a motor assembly including a cylindrical rotor in an inner circumferential surface of a rotor housing, and a cylindrical stator in an inner circumferential surface of the rotor, comprising:

a plurality of holes on a surface of the rotor housing adjacent to the stator; and a plurality of blades, each provided on one side of the hole for being opposite to a dehydration direction to a central point of the rotor housing in order to maximize the amount of cold air flowing into the inside of the rotor housing through the plurality of holes when the washing machine operates on a dehydration mode.

2. The structure as claimed in claim 1, wherein the blade has a curved shape the farther the blade extends away from the surface of the rotor housing.

3. The structure as claimed in claim 1, wherein the blade is provided downward to the lower surface of the rotor housing.

4. The structure as claimed in claim 1, wherein a plurality of grooves are provided in the surface of the blade.

5. The structure as claimed in claim 4, wherein the blade is provided downward to the lower surface of the rotor housing.

6. The structure as claimed in claim 1, wherein the blade is provided by upwardly bending the lower surface of the rotor housing.

7. The structure claimed in claim 1, wherein the blade contains a plurality of grooves as the blade extends away from the surface of the rotor housing.

8. The structure as claimed in claim 7, wherein the grooves are provided on only one surface of the blade.

9. The structure as claimed in claim 8, wherein the grooves are provided on the surface of the blade that faces the hole.

10. The structure as claimed in claim 1, wherein the blades extend upward from the surface of the rotor.

* * * * *